US009559427B2

(12) United States Patent
Darooka

(10) Patent No.: US 9,559,427 B2
(45) Date of Patent: Jan. 31, 2017

(54) HYBRID IMAGE GATHERING SYSTEMS, SATELLITE SYSTEM, AND RELATED METHODS

(71) Applicant: Orbital ATK, Inc., Dulles, VA (US)

(72) Inventor: Dilip K. Darooka, West Chester, PA (US)

(73) Assignee: Orbital ATK, Inc., Plymouth, MN (US)

( * ) Notice: Subject to any disclaimer, the term of this patent is extended or adjusted under 35 U.S.C. 154(b) by 829 days.

(21) Appl. No.: 13/800,243

(22) Filed: Mar. 13, 2013

(65) Prior Publication Data

US 2014/0327596 A1 Nov. 6, 2014

(51) Int. Cl.
*H01Q 15/00* (2006.01)
*H01Q 5/22* (2015.01)
*H01Q 19/19* (2006.01)

(52) U.S. Cl.
CPC ..... *H01Q 15/0033* (2013.01); *H01Q 5/22* (2015.01); *H01Q 19/191* (2013.01)

(58) Field of Classification Search
CPC .. H01Q 5/22; H01Q 15/0013; H01Q 15/0033; H01Q 19/19; H01Q 19/191; H01Q 19/192
See application file for complete search history.

(56) References Cited

U.S. PATENT DOCUMENTS 6,445,351 B1 * 9/2002 Baker ..... H01Q 1/22 343/725
2012/0002973 A1 * 1/2012 Bruzzi ..... H01Q 13/0208 398/116

OTHER PUBLICATIONS

Guo Y. J. et al., Offset Fresnel Zone Plate Antennas, International Journal of Satellite Communications, vol. 12 (1994), pp. 381-385.
Krieger, G. M. et al., Advanced Concepts for High-Resolution Wide-Swath SAR Imaging, Microwaves and Radar Institute, German Aerospace Center (DLR), EUSAR 2010, pp. 524-527. ISBN 978-3-8007-3272-2.
Younis, Marwan et al., Performance Comparison of Reflector-and Planar-Antenna Based Digital Beam-Forming SAR, Hindawi Publishing Corporation International Journal of Antennas and Propagation, vol. 2009 (Jun. 2009) Article ID 614931, 14 pages.

* cited by examiner

*Primary Examiner* — Robert Karacsony
(74) *Attorney, Agent, or Firm* — TraskBritt

(57) ABSTRACT

A hybrid image gathering and data transmission system is provided. The system includes at least one parabolic reflector to gather, disseminate and direct electromagnetic radiation. A beam splitter using a Fresnel zone plate (FZP) is configured and arranged to receive and/or transmit the electromagnetic radiation from or to the at least one parabolic reflector and separately focus microwave radiation and visual radiation. The beam splitter provides a gain in the microwave radiation and the visual radiation. A radio frequency (RF) receiver/transmitter receives and transmits the microwave radiation from or to the beam splitter and a focal plane array (FPA) receives the visible radiation from the beam splitter. A processor is in communication with the RF receiver and the FPA. The processor processes signals received by the RF receiver and the FPA and provides processed data to be transmitted to a remote location.

17 Claims, 7 Drawing Sheets

HYBRID IMAGE GATHERING SYSTEMS, SATELLITE SYSTEM, AND RELATED METHODS

BACKGROUND

Earth observation using low cost, low earth orbit satellites for both military and civilian applications has proliferated rapidly in recent years. Finer resolution is desired while imaging large areas during each pass of a satellite, which results in a large amount of data generation. This data is typically down-linked to a user in the field as soon as possible to be of value. In areas of interest, multiple revisits may be required to gather desired information. However, limited available link time to a ground station can hamper operations. Two types of sensing systems are typically employed to observe an area of interest during different times of day and conditions. An optical system imaging in the visible wave spectrum can be used during the daytime on a clear day. The optical system provides a fine resolution of the area of interest but is ineffective during the night or if clouds, fog, smoke, or dust are present in the atmosphere. A microwave system that images in the radio frequency (RF) spectrum can be used when the conditions are not ideal for the optical system. However, the resolution of the microwave system is not as fine as the optical system. Including an optical system and a microwave system in the same satellite is very cost prohibitive because of the weight and space needed for the separate receiving and processing systems.

For the reasons stated above and for other reasons stated below, which will become apparent to those skilled in the art upon reading and understanding the present specification, there is a need in the art for a hybrid optical and microwave system that is effective and efficient and requires a relatively small footprint.

BRIEF SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a hybrid image gathering system is provided. The system includes at least one parabolic reflector, a beam splitter, a radio frequency (RF) receiver, a focal plane array (FPA) and a processor. The at least one parabolic reflector is configured to direct incident electromagnetic radiation. The beam splitter is configured and arranged to receive the incident electromagnetic radiation from the at least one parabolic reflector and separately focus microwave radiation and visual radiation from the incident electromagnetic radiation. The beam splitter is further configured and arranged to provide a gain in the microwave radiation and visual radiation. The RF receiver is configured and arranged to receive microwave radiation from the beam splitter. The FPA is configured and arranged to receive the visible radiation from the beam splitter. The processor is in communication with the RF receiver and the FPA. The processor is configured and arranged to process signals received by the RF receiver and the FPA for transmission.

In another embodiment, another hybrid image gathering system is provided. The system includes an electromagnetic radiation directing system, a beam splitter, a radio frequency (RF) receiver/transmitter, a focal plane array (FPA) and a processor. The electromagnetic radiation directing system is configured and arranged to direct electromagnetic radiation. A beam splitter is positioned to receive incident electromagnetic radiation from the electromagnetic radiation directing system. The beam splitter is configured to separate out microwave radiation and visible radiation from the incident radiation. The beam splitter is further positioned to transmit outgoing processed data. The RF receiver/transmitter is configured and arranged to receive microwave radiation from the beam splitter and to transmit microwave radiation to the beam splitter. The FPA is configured and arranged to receive the visible radiation from the beam splitter. The processor is in communication with the RF receiver and the FPA. The processor is configured and arranged to process signals received by the RF receiver and the FPA and communicate the processed data to the RF receiver/transmitter for transmission to a remote location.

In still another embodiment, a method of monitoring an area is provided. The method includes: separating out microwave radiation and visible radiation from incident electromagnetic radiation; directing the microwave radiation to an RF receiver; directing the visible radiation to a focal plane array; processing signals from the RF receiver and the focal plane array; and communicating the processed signals to a user at a remote location.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout the figures and the specification.

DETAILED DESCRIPTION

In the following detailed description, reference is made to the accompanying drawings, which form a part hereof, and in which is shown by way of illustration, specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Embodiments of the present invention combine an optical and microwave imaging/data transmission system into a satellite. Embodiments of the hybrid system implement a parabolic aperture and the focusing capability of a beam splitter, such as a Fresnel zone plate (FZP). Embodiments provide a system with desirable gain with a small overall footprint. Moreover, embodiments provide an ability to substantially increase the data transfer rate of earth imaging satellites without increasing the footprint of the satellite by making an optical aperture and an RF aperture one and the same. As stated above, this is done by adding a beam splitter, such as an FZP.

Figure 1:
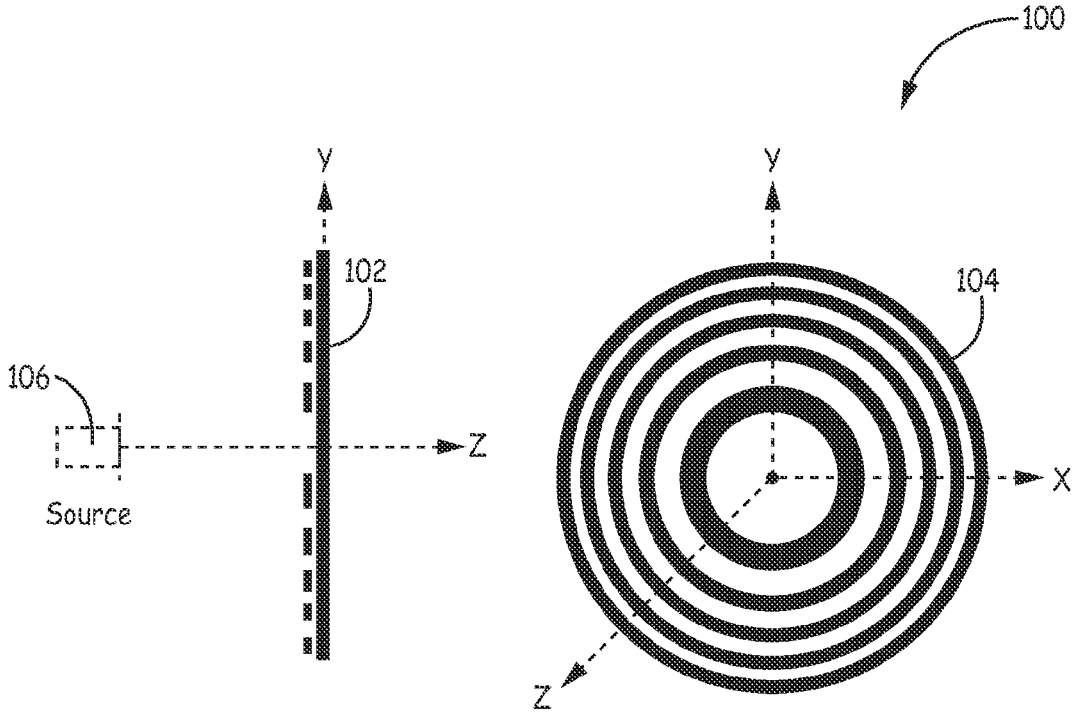
FIG. 1 (PRIOR ART)
FIG. 1 illustrates a Fresnel zone plate of the prior art.
Figure 3:
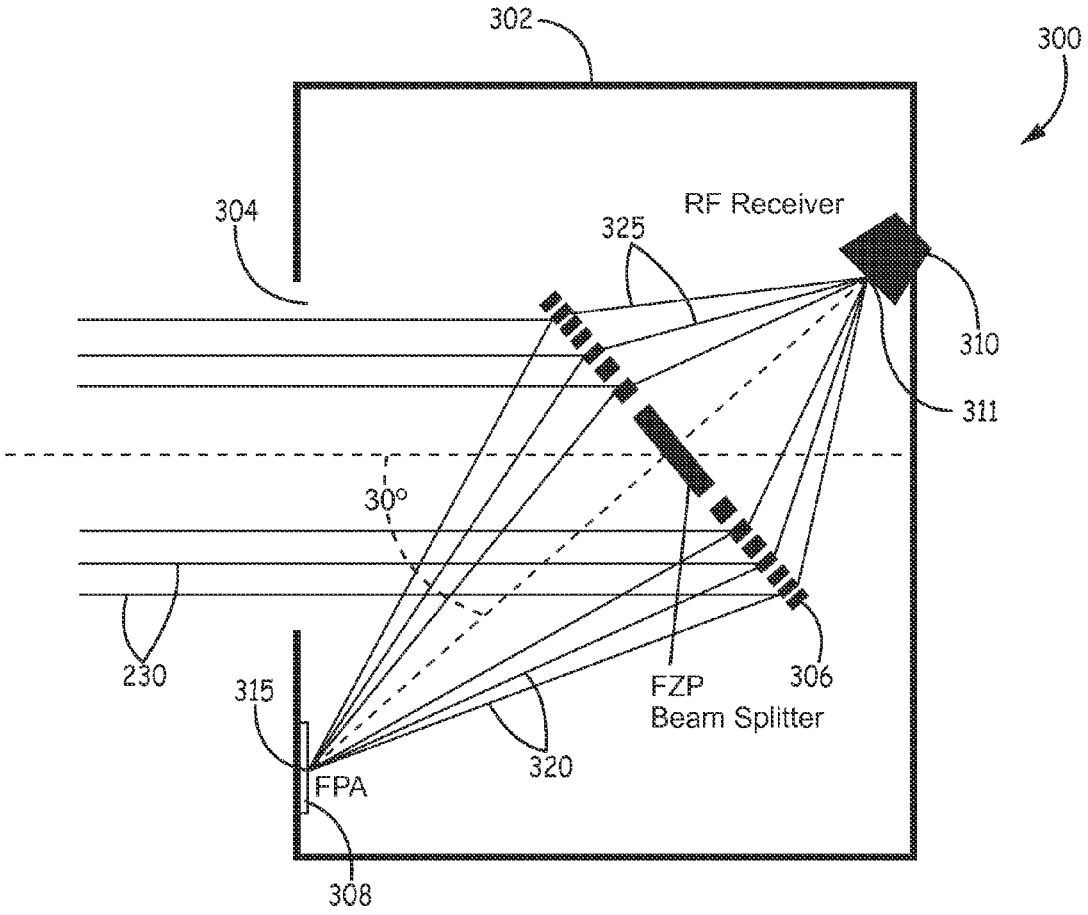
FIG. 3 illustrates a beam splitting portion of the satellite of FIG. 2.

Typically, both the RF and visible systems must work with very low energy electromagnetic signals from distant objects. Therefore, the receiving antennas used to collect the signals should have the largest feasible collection area or aperture as possible. Increasing aperture size is also very desirable because it results in a relatively small focal length requirement which more efficiently utilizes available volume in a launch vehicle. With some embodiments, using a hybrid system of a parabolic aperture and the focusing capability of the FZP antenna, a desirable gain with a smaller overall footprint of the satellite is possible. RF apertures are necessarily large to provide the desired gain over a large bandwidth. Optical reflectors, on the other hand, are typically flatter due to the difficulty of fabricating curved surfaces over large diameters. Cassegrainian configurations are typically used to fold an optical path in order to make the design more compact. Embodiments of the present invention provide a system that compromises between the size of the reflector aperture and the complexity of the multiple folded optical wave paths by inserting a beam splitter with focusing capability before the focal plane array (FPA). The beam splitter may be fabricated by forming an array of reflective metallic mirror segments of glass, quartz or other microwave-transmissive substrates. In this case, the microwave energy is transmitted through gaps between the mirror segments. Such an arrangement is generally described as an FZP discussed above. Referring to FIG. 1, an FZP 100 of the prior art is illustrated. The FZP 100 includes a thin support substrate 102 and zone plate metal rings 104. In this FZP 100 illustration, a source 106 is shown generating electromagnetic waves (or electromagnetic radiation). The overall concept stems from the fact that spherical waves from a feed create constant phase zones on the planar surface that are circular. The FZP 100 is normally a planar device where the incoming radiation is normal to the plane and produces lens-like focusing of electromagnetic waves (or electromagnetic radiation). It transforms a normally incident plane wave into a converging wave, concentrating the radiation field in a small region about a point, which is the focal point. FZP 100 has an interesting property in that it can focus both in the transmission and reflection modes. These properties of the FZP are used in embodiments in two ways. First, by using an FZP 100 as a beam splitter, the incoming radiation can be separated as either an optical wave front or a microwave radiation and measured accordingly. Second, the focusing capability of the FZP 100 is exploited to add signal gain to the incoming radiation for measurement. This gain is achieved over and above the gain derived from the parabolic aperture. Thus, the overall effect is to either increase the strength of the signal or reduce the size of the aperture. The additional gain that can be derived from the FZP 100 is a function of several parameters, as described below. In some embodiments, in order to split the beam into optical and microwave radiation to be measurable with appropriate devices, the beam splitter must be orientated at an inclination to the axial direction. This is shown in FIG. 3 and described below. Therefore, it is required to design the FZP such that the positioning of the maximum in the power radiation pattern is in the direction of the focal point. The type of FZP having this property is an elliptical FZP as discussed below. This requires a parabolic secondary reflector to be used to generate plane waves for interaction with the FZP.

Figure 2:
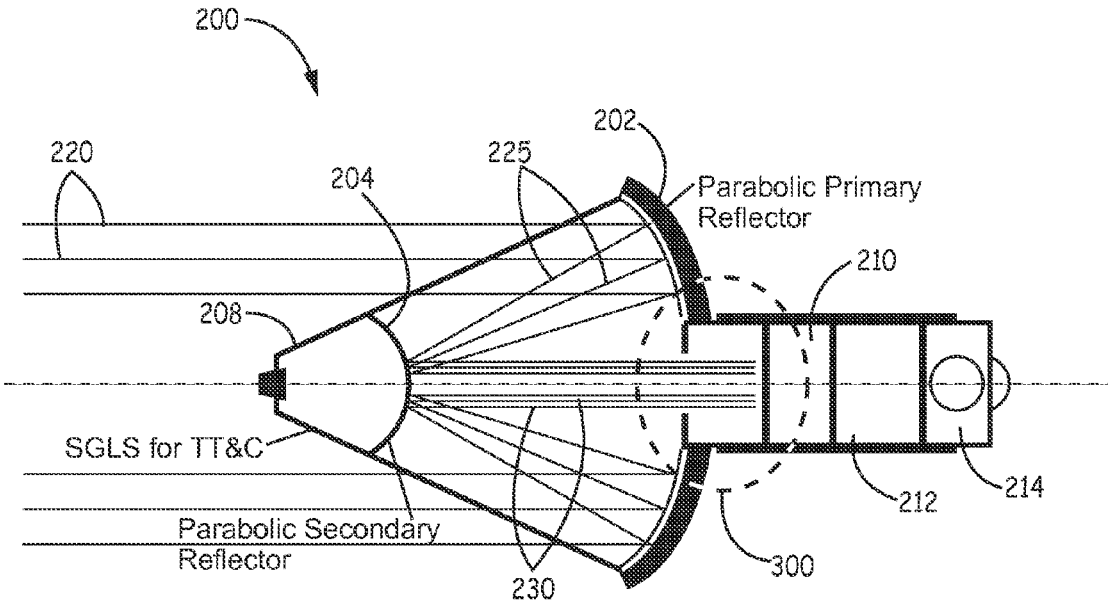
FIG. 2 illustrates a satellite of an embodiment of the present invention.

Referring to FIG. 2, a satellite 200 including a hybrid optical and microwavable imaging system is illustrated. The imaging system includes a parabolic primary reflector 202 that reflects incident electromagnetic waves 220. The incident electromagnetic waves 220 are reflected by the primary reflector 202 as primary reflected electromagnetic waves 225 to a parabolic secondary reflector 204. The parabolic secondary reflector 204, in turn, reflects the waves as secondary reflected electromagnetic waves 230 into a beam-splitting portion 302 of the hybrid optical and microwavable imaging system. The beam-splitting portion 302 is described in the close-up section 300 further described below. The satellite 200, in this embodiment, further includes a processing portion 210 that is used to process signals from the hybrid optical and microwavable imaging system as well as other process, such as, but not limited to, operations of the satellite 200 and the positioning of the satellite 200. The satellite 200 also includes a function portion 212 that is used to at least position the satellite 200 under direction of the processing portion 210 and a power system 214 that powers the portions of the satellite 200. The satellite 200 includes a satellite ground link system (SGLS) 208 that is in communication with the processing portion 210. The SGLS 208 provides task, telemetry and communication functions for the satellite 200.

Figure 4:
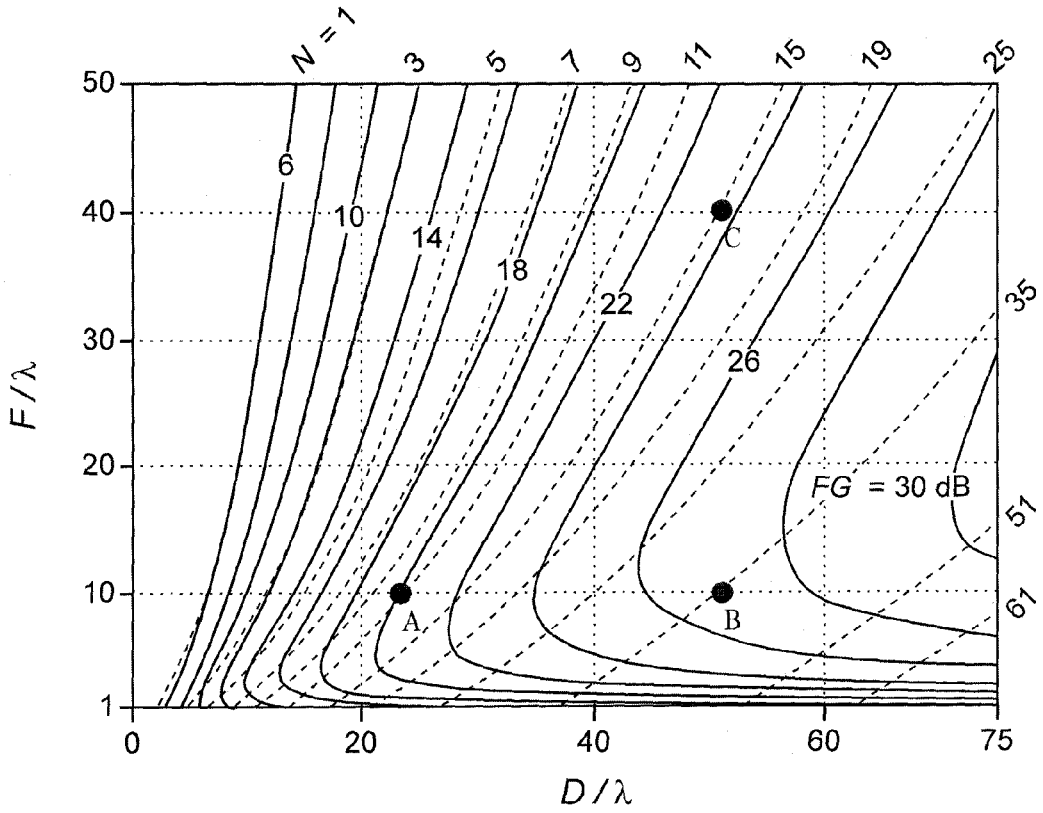
FIG. 4 is a graph illustrating properties of an elliptical Fresnel zone plate used in an embodiment of the present invention.

Close up section 300 illustrates the beam splitting portion 302 of the satellite 200. As illustrated, the secondary reflected electromagnetic waves 230 pass through an opening 304 in the beam splitting portion 302 of the satellite 200. The secondary reflected electromagnetic waves 230 are incident on the FZP beam splitter 306. In this embodiment, a surface of the FZP beam splitter 306 is positioned at a 30 degree angle in relation to the secondary reflected electromagnetic waves 230. The FZP beam splitter 306 reflects waves in the visible spectrum, such as optical waves 320 of the secondary reflected electromagnetic waves 230 to a focal plane array (FPA) 308 that senses the optical radiation. The FPA 308 is in communication with the processing portion 210 of the satellite 200. The FZP beam splitter 306 further directs (e.g., diffracts) the waves in the RF spectrum (microwaves 325) in the secondary reflected electromagnetic waves 230 to an RF receiver 310 that senses the RF radiation. The RF receiver 310 is in communication with the processing portion 210 of the satellite 200. Both the FPA 308 and the RF receiver 310 are in communication with a processor 610 (FIG. 6) in the processing portion 210 of the satellite 200. As discussed above, additional gain is derived from the FZP. The additional gain is a function of several parameters as shown in FIG. 4. The primary parameters in FIG. 4 are $D/\lambda$ (ratio of the diameter of the FPZA and the wavelength of the radiation) and $F/\lambda$ (ratio of the focal length of the FPZA and the wavelength of the radiation). The other parameters are N (number of interferometric rings) and FG (focusing gain).

Figure 5:
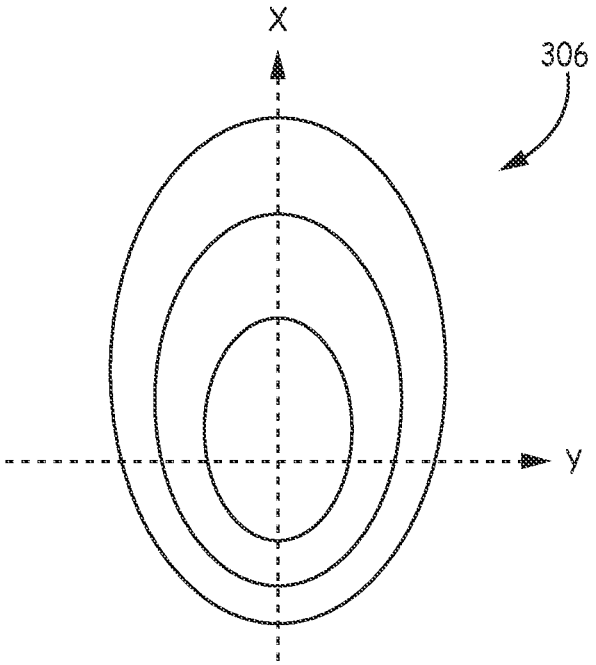
FIG. 5 is an illustration of an elliptical Fresnel zone plate used in an embodiment of the present invention.

In order to split a beam into optical and microwave radiation, with their respective signals being measurable with respective FPA 308 and RF receiver 310, the beam splitter 306 must be orientated at an inclination to the axial direction, as shown in FIG. 3. Therefore, it is required to design the FZP beam splitter 306 where the position of the maximum in the power radiation pattern is in the direction of focal points 311 and 315 for RF and visible spectrum, respectively. The type of FZP having this property is an elliptical FZP 306, as shown in FIG. 5, as opposed to an FZP with circular rings as shown in prior art FIG. 1. Using the elliptical FZP 306 requires a parabolic secondary reflector 204 (as shown in FIG. 2) to be used to generate plane waves for interaction with the FZP 306.

Figure 6:
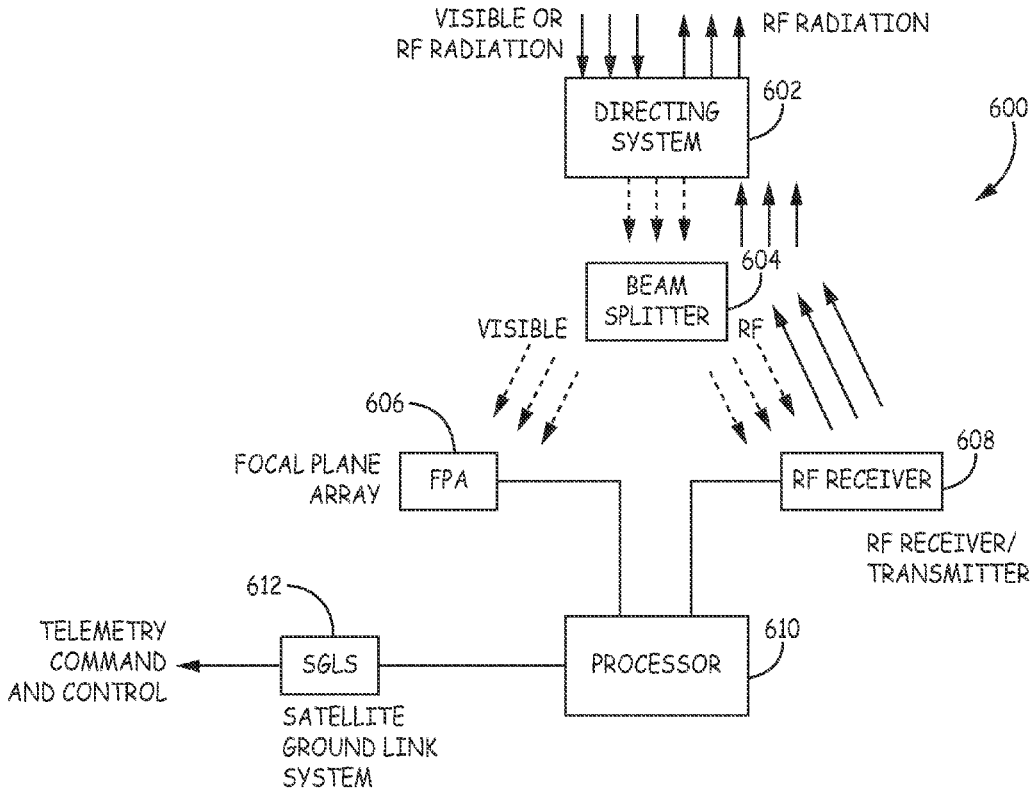
FIG. 6 is a block diagram of a hybrid optical and microwave imaging satellite system of one embodiment of the present invention.

Referring to FIG. 6, a block diagram illustration of a hybrid optical and microwave imaging satellite system 600 is provided. As illustrated, the system 600 includes a directing system 602 that directs the incoming and outgoing electromagnetic radiation to and from the beam splitter 604. As illustrated in FIG. 6, the directing system 602 may include one or more parabolic reflectors. The beam splitter 604 splits the incoming electromagnetic radiation sending visible radiation to the focal plane array 606 and microwave radiation to the RF receiver 608. Alternatively, the beam splitter 604 returns outgoing RF radiation from the RF receiver 608, which in this case acts as a transmitter. Hence, in one embodiment 608 is an RF receiver/transmitter. Further illustrated in FIG. 6 is a processor 610 (or controller) that is in communication with the focal plane array 606 and the RF receiver 608. The processor 610 is configured to process signals received from the focal plane array 606 and the RF receiver 608. The processor 610 communicates with the satellite ground link system 612, which provides communication between a satellite and a control station on the ground. The processor 610 communicates its processed information regarding the signals from the focal plane array 606 and the RF receiver 608 either through the satellite ground link system (SGLS) 612 or through the main parabolic aperture, as appropriate.

Figure 7:
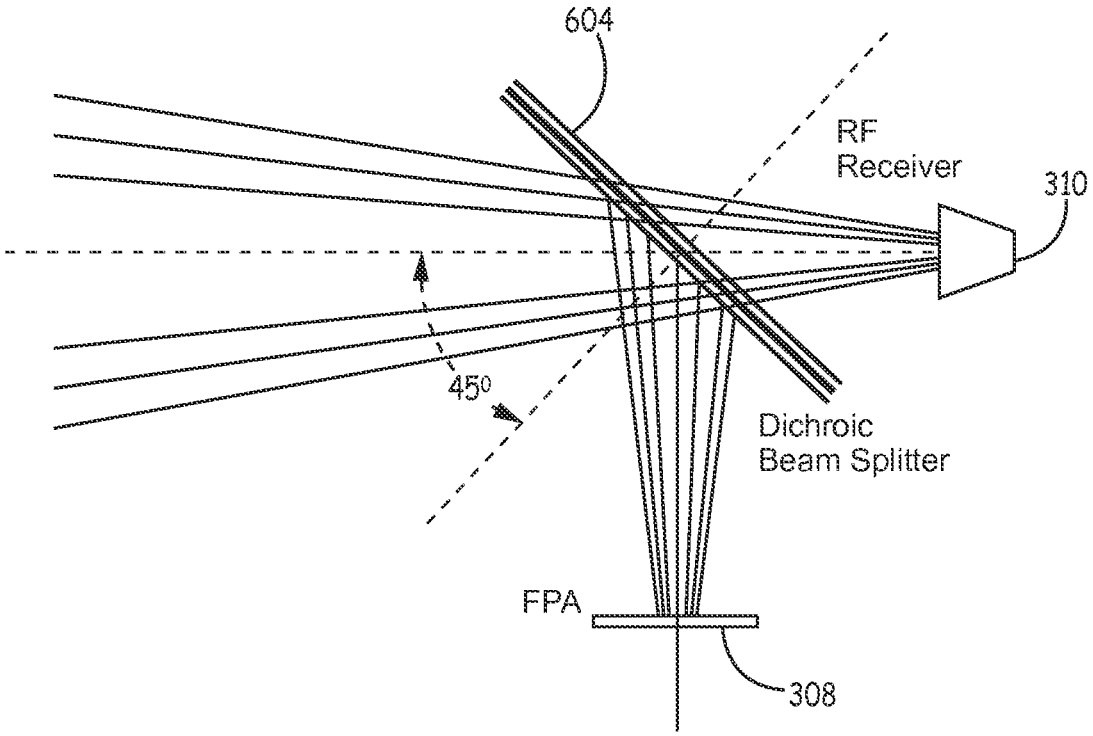
FIG. 7 illustrates a dichroic beam splitter used in an embodiment of the present invention.

As discussed above, in one embodiment, the beam splitter is an FZP 306. However, in another embodiment, the beam splitter 604 is covered with an RF-transmissive and optically reflective dichroic coating. This beam splitter embodiment is illustrated in FIG. 7 and would be incorporated in satellite 200 described above. In this embodiment, the beam splitter 604 is positioned at approximately a 45 degree angle to the incident electromagnetic radiation. In this embodiment, however, no gain is realized on top of the gain obtained with the use of the primary parabolic aperture.

In some embodiments, the RF energy can be utilized to form synthetic aperture radar (SAR) to provide imagery at night or when the earth is obscured by clouds, fog, smoke, or dust, etc. In addition, the RF energy can be used as a communication link for high rate data transfer. The high data rate is achieved by using the same large parabolic aperture that is used to receive the radiation. In this case, the FZPA also adds to the overall gain during data transmission to remote locations. Further, in some embodiments, the entire architecture is easily made of parts of a satellite bus to deliver an integrated system suitable for launches of multiple units on various launch vehicles. Thus, a baffle, which is essentially a cavity to stop stray radiation from hitting the measuring device, is an integral part of the bus. The baffle, in this case, becomes an integral part of the bus and is situated behind the parabolic aperture. Alternatively, it is easily conceivable to have the baffle situated in front of the parabolic aperture.

Although specific embodiments have been illustrated and described herein, it will be appreciated by those of ordinary skill in the art that any arrangement, which is calculated to achieve the same purpose, may be substituted for the specific embodiments shown. This application is intended to cover any adaptations or variations of the present invention. Therefore, it is manifestly intended that this invention be limited only by the claims and the equivalents thereof.

The invention claimed is:

1. A hybrid image gathering system, the system comprising:

at least one parabolic reflector configured to direct incident electromagnetic radiation;

a beam splitter comprising a Fresnel zone plate (FZP) beam splitter having a plurality of radially spaced elliptical rings, the beam splitter positioned at a select angle in relation to the incident electromagnetic radiation, the beam splitter configured and arranged to receive the incident electromagnetic radiation from the at least one parabolic reflector and separately focus microwave radiation and visual radiation from the incident electromagnetic radiation, wherein the Fresnel zone plate (FZP) beam splitter is configured to direct the microwave radiation through the Fresnel zone plate (FZP), the beam splitter further configured and arranged to provide a gain in the microwave radiation and the visual radiation;

a radio frequency (RF) receiver configured and arranged to receive the microwave radiation from the beam splitter;

a focal plane array (FPA) configured and arranged to receive the visual radiation from the beam splitter; and a processor in communication with the RF receiver and the FPA, the processor configured and arranged to process signals received by the RF receiver and the FPA for transmission.

2. The system of claim 1, wherein the RF receiver is configured to transmit the microwave radiation containing information regarding the processed signals back through the beam splitter and the at least one parabolic reflector to communicate the information to a remote location.

3. The system of claim 1, wherein the at least one parabolic reflector further comprises:

a primary reflector; and a secondary reflector, the primary reflector configured and arranged to direct the incident electromagnetic radiation to the secondary reflector, the secondary reflector configured and arranged to direct the incident electromagnetic radiation to the beam splitter.

4. The system of claim 1, wherein the beam splitter is positioned at a select oblique angle relative to an intended direction of travel of the incident electromagnetic radiation through the beam splitter.

5. The system of claim 1, wherein the plurality of radially spaced rings of the Fresnel zone plate (FZP) beam splitter comprises a plurality of noncircular, elliptical rings.

6. The system of claim 1, further comprising:

a transmitter in communication with the processor to transmit the signals processed by the processor to a remote location.

7. The system of claim 6, wherein the transmitter is part of a satellite ground link system (SGLS).

8. The system of claim 6, wherein the transmitter is part of a data transmission link through the beam splitter and the at least one parabolic reflector.

9. A method of monitoring an area, the method comprising:

separating out microwave radiation and visible radiation from incident electromagnetic radiation with the hybrid image gathering system of claim 1;

directing the microwave radiation to the RF receiver;

directing the visible radiation to the focal plane array;

processing signals from the RF receiver and the focal plane array with the processor; and communicating the processed signals to a user at a remote location.

10. The method of claim 9, wherein separating out microwave radiation and visible radiation from the incident electromagnetic radiation further comprises:

directing the incident electromagnetic radiation to the Fresnel zone plate (FZP).

11. The method of claim 9, wherein directing the incident electromagnetic radiation to the Fresnel zone plate (FZP) further comprises:

reflecting the incident electromagnetic radiation off a parabolic primary reflector to a parabolic secondary reflector; and reflecting the incident electromagnetic radiation off the parabolic secondary reflector to the FZP.

12. The method of claim 9, further comprising:

using RF energy received by the RF receiver to form a synthetic aperture radar.

13. The method of claim 9, further comprising:

using a satellite ground link system to communicate the processed signals.

14. A hybrid image gathering system comprising:

at least one parabolic reflector configured to direct incident electromagnetic radiation;

a beam splitter comprising a Fresnel zone plate (FZP) beam splitter having elliptical zones, the beam splitter positioned at a select angle in relation to the incident electromagnetic radiation, the beam splitter configured and arranged to receive the incident electromagnetic radiation from the at least one parabolic reflector and separately focus microwave radiation and visual radiation from the incident electromagnetic radiation by reflecting at least a portion of the visual radiation and angularly redirecting at least a portion of the microwave radiation as the at least a portion of the microwave radiation passes through the beam splitter, the beam splitter further configured and arranged to provide a gain in the microwave radiation and the visual radiation;

a radio frequency (RF) receiver/transmitter configured and arranged to receive microwave radiation from the beam splitter after the at least a portion of the microwave radiation has been angularly redirected by the beam splitter and to transmit microwave radiation to the beam splitter;

a focal plane array (FPA) configured and arranged to receive the visible radiation from the beam splitter; and a processor in communication with the RF receiver and the FPA, the processor configured and arranged to process signals received by the RF receiver and the FPA and communicate the processed data to the RF receiver/transmitter for transmission to a remote location.

15. The system of claim 14, wherein the at least one parabolic reflector further comprises:

a primary reflector; and a secondary reflector, the primary reflector configured and arranged to direct the incident electromagnetic radiation to the secondary reflector, the secondary reflector configured and arranged to direct the incident electromagnetic radiation to the beam splitter.

16. The system of claim 14, wherein the beam splitter is positioned at an acute angle between 30 degrees and 45 degrees in relation to an intended direction of travel of the incident electromagnetic radiation through the hybrid image gathering system and the beam splitter.

17. A hybrid image gathering system, the system comprising:

at least one parabolic reflector configured to direct incident electromagnetic radiation;

a beam splitter comprising a Fresnel zone plate (FZP) beam splitter including elliptical zones, the beam splitter positioned at a select angle in relation to the incident electromagnetic radiation, the beam splitter including configured and arranged to receive the incident electromagnetic radiation from the at least one parabolic reflector and separately focus microwave radiation and visual radiation from the incident electromagnetic radiation, the beam splitter further configured and arranged to provide a gain in the microwave radiation and the visual radiation;

a radio frequency (RF) receiver configured and arranged to receive the microwave radiation from the beam splitter;

a focal plane array (FPA) configured and arranged to receive the visual radiation from the beam splitter; and a processor in communication with the RF receiver and the FPA, the processor configured and arranged to process signals received by the RF receiver and the FPA for transmission.

* * * * *